US009387364B2

(12) United States Patent
Penxa

(10) Patent No.: US 9,387,364 B2
(45) Date of Patent: Jul. 12, 2016

(54) INTERCHANGEABLE BOWLING FINGER INSERT APPARATUS

(71) Applicant: Jerome M. Penxa, Romeo, MI (US)

(72) Inventor: Jerome M. Penxa, Romeo, MI (US)

( * ) Notice: Subject to any disclaimer, the term of this patent is extended or adjusted under 35 U.S.C. 154(b) by 0 days.

(21) Appl. No.: 14/523,388

(22) Filed: Oct. 24, 2014

(65) Prior Publication Data

US 2015/0119156 A1 Apr. 30, 2015

Related U.S. Application Data

(60) Provisional application No. 61/896,181, filed on Oct. 28, 2013.

(51) Int. Cl.
*A63B 37/00* (2006.01)

(52) U.S. Cl.
CPC ..... *A63B 37/0002* (2013.01)

(58) Field of Classification Search
CPC ..... A63B 37/02
USPC ..... 473/129, 130
See application file for complete search history.

(56) References Cited

U.S. PATENT DOCUMENTS

| | | | |
|---|---|---|---|
| 533,011 | A | 1/1895 | Huntoon |
| 712,192 | A | 10/1902 | Immen |
| 1,080,307 | A | 12/1913 | Sondheimer |
| 2,210,528 | A | 8/1940 | Darby |
| 2,314,811 | A | 3/1943 | Akin |
| 2,435,327 | A | 2/1948 | Seurynck |
| 2,436,976 | A | 3/1948 | Seurynck |
| 2,460,385 | A | 2/1949 | Hausman |
| 2,646,985 | A | 7/1953 | Nagy et al. |
| 2,842,367 | A | 7/1958 | Keith |
| 2,844,375 | A | 7/1958 | Nestor |
| 2,950,111 | A | 8/1960 | Kunevicius |
| 3,001,793 | A | 9/1961 | Insetta |
| 3,004,762 | A | 10/1961 | Frost |
| 3,012,783 | A | 12/1961 | Bunk et al. |
| 3,102,725 | A | 9/1963 | Jarus |
| 3,129,002 | A | 4/1964 | Bednash |
| 3,416,796 | A | 12/1968 | Ginder |
| 3,804,412 | A | 4/1974 | Chetirko |
| 3,861,681 | A | 1/1975 | Kelsey |
| 4,247,102 | A | 1/1981 | Seyler |
| 4,289,312 | A | 9/1981 | Heimbigner |
| 4,358,112 | A | 11/1982 | Straborny |
| 4,416,452 | A | 11/1983 | Heimbigner |

(Continued)

OTHER PUBLICATIONS

<http://www.ncaba.org/bowlmag/archives/9710scot.htm> (Oct. 10, 2013).

(Continued)

*Primary Examiner* — William Pierce
(74) *Attorney, Agent, or Firm* — Brooks Kushman P.C.

(57) ABSTRACT

An interchangeable finger insert apparatus for a bowling ball includes a cylindrical outer body configured to be disposed in a bowling ball hole. The outer body defines an internal bore open to a first end of the outer body and a number of protrusions extending from an inner surface of the bore. The finger insert apparatus also includes a cylindrical inner slug sized to be inserted into the bore of the outer body. The inner slug defines a plurality of helical grooves corresponding to the protrusions of the outer body. At least one of the protrusions is uniquely sized relative to other protrusions and corresponds to only one of the helical grooves such that the slug may be rotatably inserted to a single set position.

18 Claims, 3 Drawing Sheets

(56) References Cited

U.S. PATENT DOCUMENTS

| | | | |
|---|---|---|---|
| 4,560,162 | A | 12/1985 | Miller |
| 4,561,654 | A | 12/1985 | Haza |
| 4,569,520 | A | 2/1986 | Yamane |
| 4,585,230 | A | 4/1986 | Martin |
| 4,623,149 | A | 11/1986 | Herman |
| 4,699,380 | A | 10/1987 | Mace |
| 4,778,178 | A | 10/1988 | Haza |
| 4,892,308 | A | 1/1990 | Gaunt |
| 4,968,033 | A | 11/1990 | Aluotto |
| 5,118,106 | A | 6/1992 | Goldman |
| 5,308,061 | A | 5/1994 | Bernhardt |
| 5,505,666 | A | 4/1996 | Arsenault |
| 5,520,582 | A | 5/1996 | Lathrop |
| 5,738,592 | A | 4/1998 | Saunders |
| 5,795,236 | A | 8/1998 | Alberts et al. |
| 5,800,276 | A | 9/1998 | Hill |
| 6,280,343 | B1 | 8/2001 | Scheid et al. |
| 6,830,518 | B2 | 12/2004 | Graskewicz |
| 7,044,863 | B1 | 5/2006 | Brewster |
| 7,048,636 | B1 | 5/2006 | Sill |
| 7,074,130 | B2 | 7/2006 | Haisley |
| 7,762,903 | B2 | 7/2010 | Bernhardt |
| 2009/0048033 | A1 | 2/2009 | Shockley |

OTHER PUBLICATIONS

<http://www.premierbowlers.com/it.htm> (Oct. 10, 2013).
<http://www.bowl.com/Equipment_Specs/Additional_Resources/Approved_Removable_Bowling Ball Devices> (Oct. 9, 2013).
<http://www..turbogrips.com/products_switch_grip.php> (Oct. 9, 2013).

INTERCHANGEABLE BOWLING FINGER INSERT APPARATUS

CROSS-REFERENCE TO RELATED APPLICATIONS

This application claims the benefit of U.S. Provisional Application Ser. No. 61/896,181 filed Oct. 28, 2013, the disclosure of which is hereby incorporated in its entirety by reference herein.

TECHNICAL FIELD

The present disclosure relates to interchangeable finger inserts for a bowling ball.

BACKGROUND

Bowling balls employ a variety of drill patterns for three-hole layouts. Two upper finger holes are separated laterally from each other by a bridge distance. The thumb hole is separated vertically from the finger holes by a span distance. Depending on a bowler's preference, the finger hole pattern may be drilled at an off-center position relative to the center of gravity of the ball to achieve a desired influence on ball trajectory. This allows bowlers to have a preferable amount of tracking, or curved trajectory, on the ball's approach toward bowling pins.

Bowlers may have a range of release types that also influence ball trajectory. A bowler with high speed and little hand rotation will have relatively low hooking action, particularly toward the back end of the roll. Likewise, a bowler with a lower ball speed and more hand rotation will tend to have much larger hooking action and a stronger back-end hook. During the initial portion of a ball approach, the force related to ball linear velocity may greatly outweigh the rotational force, and the ball may skid in a relatively straight direction while rotating in an oblique direction. During a middle portion of the ball approach, the force from oblique rotation influences ball trajectory, causing a hooking pattern of motion. Once the pattern changes, the ball begins to roll more in an oblique direction to approach the pins from an indirect angle.

The release type of a bowler's throw may make it desirable for a custom finger interface for the bowler to have more consistent control over the release. Unique finger hole shapes may be suitable to enhance bowler comfort as well as ball control. A custom finger interface may be beneficial for the finger and/or the thumb holes of a bowling ball.

SUMMARY

In at least one embodiment, an interchangeable finger insert apparatus for a bowling ball includes a cylindrical outer body configured to be disposed in a bowling ball hole. The outer body defines an internal bore open to a first end of the outer body and a number of protrusions extending from an inner surface of the bore. The finger insert apparatus also includes a cylindrical inner slug sized to be inserted into the bore of the outer body. The inner slug defines a plurality of helical grooves corresponding to the protrusions of the outer body. At least one of the protrusions is uniquely sized relative to other protrusions and corresponds to only one of the helical grooves such that the slug may be rotatably inserted to a single set position.

In at least one embodiment, an interchangeable finger insert apparatus for a bowling ball includes a cylindrical outer body defining an internal bore being open to a first end of the outer body. At least one protrusion extends from an inner surface of the bore. An inner slug is capable of insertion into the bore of the outer body and defines a plurality of helical grooves on an outer surface. The inner slug also defines a retaining socket disposed at a terminal end of at least one helical groove. At least one of the helical grooves corresponds to at least one protrusion of the outer body such that the at least one protrusion traverses at least one corresponding helical groove to nest within the retaining socket to define a set position of the inner slug.

A bowling system having an interchangeable finger insert includes a bowling ball defining a blind hole. A cylindrical outer body is disposed in the blind hole and defines an internal bore being open to a first end of the outer body. The outer body also includes at least one protrusion extending from an inner surface of the bore near a second end of the outer body. The bowling system also includes a compression element affixed to the second end of the outer body. The bowling system further includes an inner slug sized to fit within the bore of the outer body. The inner slug defines a plurality of helical grooves on an outer surface that correspond to the at least one protrusion of the outer body. The inner slug is capable of rotatable insertion into the bore such that the at least one protrusion traverses at least one helical groove and the compression element generates a resistive force to retain the inner slug in a set position.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
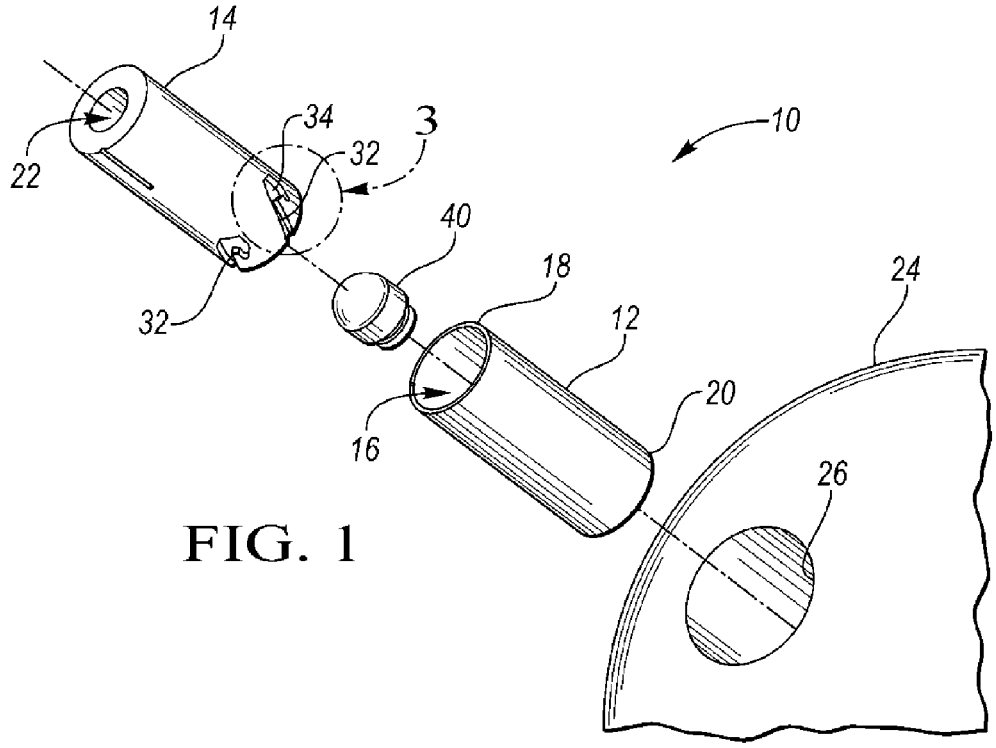
FIG. 1 is an exploded view of a bowling system.

Referring to FIG. 1, a multi-piece interchangeable finger insert bowling system 10 is provided, having an outer body 12 and an inner slug 14. The outer body is generally cylindrical with a hollow internal bore 16. The outer body 12 further defines a first end 18 being open to the internal bore 16, and a second end 20 having a base surface. The inner slug 14 is configured to be removably inserted into the internal bore 16 of the outer body 12. A proximal end of the inner slug is directed toward the center of a bowling ball 24 to correspond to the second end 20 of the outer body 12. The inner slug 14 also has an internal finger cavity 22 open to a distal end to receive the finger of a bowler. The inner slug 14 may be provided with the finger cavity 22 predrilled, or the finger cavity 22 may be created in the inner slug 14 after the finger insert system is fitted to the bowling ball 24. In at least one embodiment, the inner slug is provided with an undersized cylindrical hole to facilitate centering a drill bit which creates the final finger cavity 22. The finger cavity 22 may be further created with a custom shape as dictated for example, by a bowler's comfort or desired characteristics of ball trajectory.

The outer body 12 may be affixed to the bowling ball 24 within a larger blind hole 26 that is drilled into the ball. For example, the outer body 12 may be permanently adhered to the bowling ball 24 with the second end 20 oriented closer to the center of the ball. The open first end 18 of the outer body 12 is directed outwardly from the center of the bowling ball 24 and is configured to receive the inner slug 14. The inner slug 14 may be removably inserted into the internal cavity 16 of the outer body 12. In at least one embodiment, the blind hole 26 is drilled into the bowling ball 24 oversized to allow for sufficient material between the finger cavity 22 and a side wall of the blind hole 26. In at least one embodiment, the blind hole 26 is sized to receive the multi-piece assembly, and is around 1.5 inches in diameter. Further, the nominal wall thickness of the outer body 12 may be around 0.0625 inches. Alternative thicknesses may be employed depending, for example, on the material selection, or desired stiffness and strength of the multi-piece assembly.

An interchangeable finger insert system according to the present disclosure overcomes several issues concerning removable finger inserts. The material of the inner slug 14 is selected to balance strength requirements and bowler comfort. The slug material is soft enough to easily drill or carve out the finger cavity 22 for thumb insertion. At the same time, the material of the inner slug 14 is strong enough to remain attached within the internal cavity 16 during the loading applied during a bowling throw and release. Further, the inner slug 14 may be arranged to be easily releasable for interchange with different bowling balls. Alternatively, for a single given bowling ball a first inner slug can be replaced with a second inner slug having a different finger cavity size or shape to accommodate finger swelling or a different bowler for example.

In at least one embodiment the outer body 12 is made of a thermoplastic acrylonitrile butadiene styrene (ABS) material. Alternatively, the injection grade thermoplastic Acetal may be similarly suitable. The inner slug 14 may be provided as a thermoplastic polyurethane (TPU) material. In a preferred embodiment, a thermoset resin may be suitable and provide a more stable inner slug that is resilient to bowling loads and has increased durability. While these materials are provided by way of example, it is contemplated that other material combinations, both plastic and non-plastic, may be suitable for certain embodiments described herein. It is further contemplated that the materials of both of the inner slug 14 and the outer body 12 may be selected such that the slug material yield strength is less than the outer body material yield strength. In the case of a failure of any of the retention features, the creation of a replacement slug may be cheaper and less time consuming compared to removing and replacing the outer body within the bowling ball.

Figure 2:
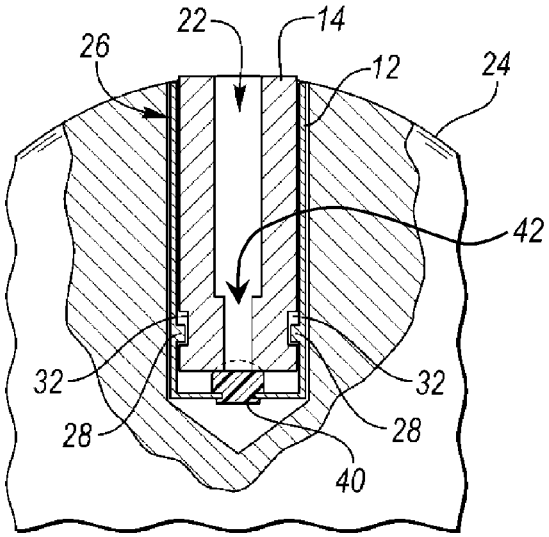
FIG. 2 is a cross-sectional view along a centerline of the assembled bowling system of FIG. 1 in a set position.
Figure 3:
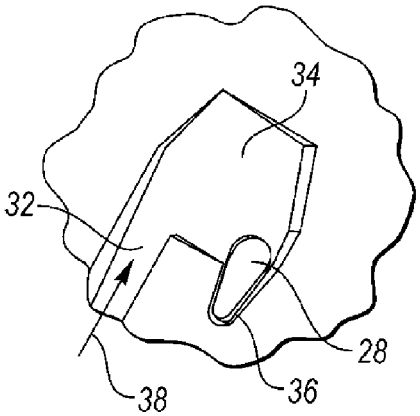
FIG. 3 is a schematic detailed view 3 of FIG. 1.

Referring collectively to FIGS. 1 through 3, one or more protrusions 28 are provided on an inner surface 30 of the cavity 16 of the outer body 12. Corresponding helical grooves 32 are provided about a portion of an outer surface of the inner slug 14. Upon a rotational insertion of the inner slug 14, the protrusions 28 of the outer body 12 cooperate to interlock with the grooves 32 of the inner slug 14. Once the inner slug is seated in a final set position, loads from bowling throws are distributed across a large portion of the outer surface of the inner slug 14. This load distribution helps to avoid local stresses which may cause failure and detachment of the inner slug 14 from the bowling ball 24. According to one example, helical grooves extend from the second end of the inner slug over about 50 percent of a total length of the inner slug body. In additional examples, the helical grooves extend over substantially less than 50 percent of the length of the inner slug body, and more robust protrusions are employed.

A retaining socket 34 may be disposed at a terminal end of at least one of the helical grooves 32. The retaining socket 34 includes a detent portion 36 which allows the protrusion 28 to nest in a corresponding shape that is offset from a general insertion path of the helical grooves 32 denoted by arrow 38. As the inner slug is rotated during insertion, the protrusions traverse the helical grooves along the insertion direction denoted by arrow 38. Toward the end of travel the protrusion 28 seats in the detent portion 36 locking the inner slug 14 in the set position. In at least one embodiment the protrusion 28 defines an oblong shape to nest within the detent portion 36 of the retaining socket.

A compression element 40 may also be used to help retain the inner slug in the set position. In the example described above having a retaining socket, the compression element 40 may generate a vertical resistive force between the outer body 12 and the inner slug 14 as a result of insertion into the internal bore. The vertical force helps to maintain the protrusion in a seated position within the detent portion of the retaining socket. During insertion, the inner slug 14 may be vertically over-traveled to generate the resistive force. The compression element 40 is over-compressed, then allowed to rebound to the final set position. In at least one embodiment, the compression element 40 is an elastomer button that includes a domed upper portion having a design interference with the inner slug 14, and a lower portion that is affixed to the base of the outer body 12. In one example, the compression element 40 may be formed from Santoprene™.

Ease of insertion and removal of the slug is a further aspect of the present disclosure. A bowler may want to change to a different slug on a given ball, or install a preferred slug on a different bowling ball during a game. Therefore it may be desirable to configure the slug to be both installable and removable by hand, and without the need for a tool. This makes it convenient for users to quickly change slugs.

Alternatively, the interchangeable finger insert system of the present disclosure may be provided with a tool to provide a user increased leverage to insert and remove the inner slug. In at least one embodiment, a base portion of the finger cavity 22 may include a keyed opening 42 to allow the tool to impart torque upon the slug. Specifically, the base of the finger cavity 22 may include hexagonally shaped keyed opening 42 near the lower portion to receive a correspondingly shaped tool. In this way, if the inner slug becomes stuck within in the outer body, a user may use the tool to unseat the slug. In alternative embodiments, the keyed opening 42 may be rectangular so as to receive a flat head screwdriver to impart torque on the inner slug 14. The keyed opening 42 within the finger cavity 22 is preferably recessed to avoid contact with a bowler's finger when holding the bowling ball.

Figure 4:
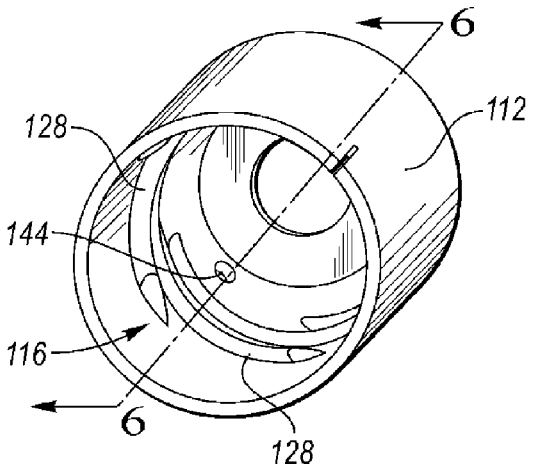
FIG. 4 is a first end perspective view of an alternate embodiment outer body.
Figure 5:
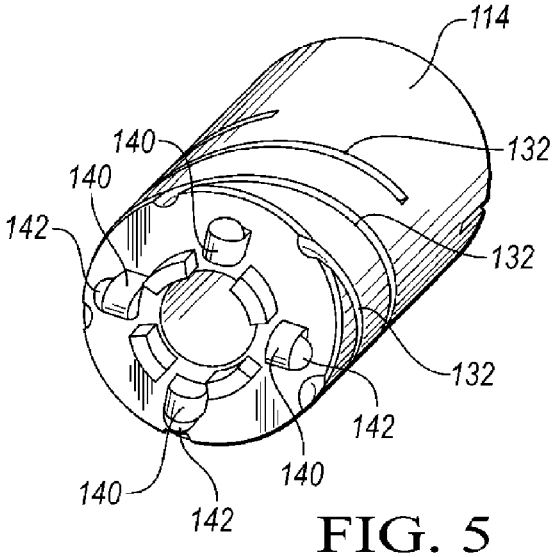
FIG. 5 is a second end perspective view of an alternate embodiment inner slug that corresponds to the outer body of FIG. 4.

Referring to FIGS. 4 and 5, an alternate embodiment includes threading on an outer body 112. The outer body 112 includes helical protrusions 128 on an inner surface within an internal bore 116. The protrusions 128 are provided with a helical shape that corresponds to the shape of helical groves 132. The threading used to hold the inner slug and the outer body together is arranged to create axial motion without the need for a large angle of rotation. The thread angle may be arranged to minimize the total rotation angle required to fully seat the inner slug. In at least one embodiment, five individual helical threads are provided. Additionally, an approximately 45 degree angle on the threading allows for about 180 degrees of rotation to create about 1.75 inches of axial travel to fully seat the inner slug within the outer body. It is contemplated that other thread angles may be suitable to balance slug retention in the ball in order to vary the overall rotation angle required to fully seat the slug during installation.

In the embodiment of FIGS. 4 and 5, male locking features 140 extend from the proximal end of the inner slug 114. The male locking features 140 include at least one deformable prong 142 extending laterally. In one example, each prong includes a hemispherical shape at an end. When the inner slug 114 is driven towards the final set position, interference is created between the hemispherical shape of the prongs 142 and an inside portion of the outer body 112 near the base surface. Once at the fully seated final set position, the hemispherical shape of each prong 142 may seat into a recessed female locking feature 144 of the outer body 112 such that a deflection of the prong is relieved. In one example, the female locking features 144 may be concave to correspond to the hemispherical shape of the prongs 142. Once the hemispherical portions are engaged in the female locking features 144, the final set position of the inner slug 114 may be releasably retained. In at least one embodiment, the prongs 142 may extend axially about 0.25 inches from the proximal end of the inner slug 114, and the hemispherical portions may have a diameter of about 0.188 inches. Although hemispherical shapes are mentioned by way of example, it is contemplated that a number of smooth or rounded shapes may be suitable to serve as lead-in features to guide the prongs to engage the female locking feature of the outer body.

Figure 6:
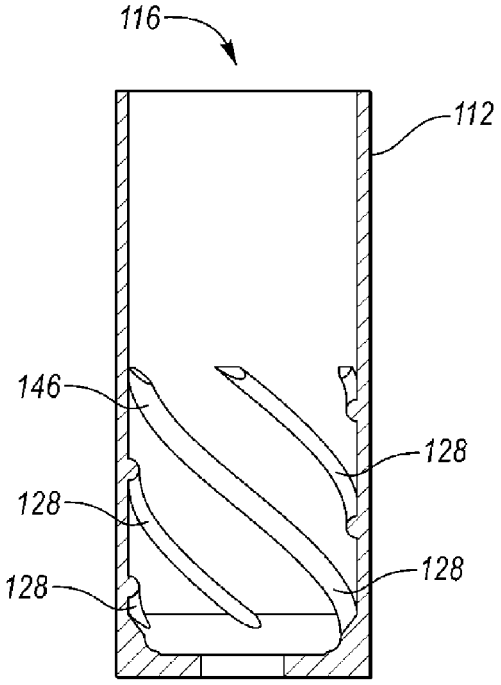
FIG. 6 is a cutaway view along line 6-6 of the alternate embodiment outer body of FIG. 4.
Figure 7:
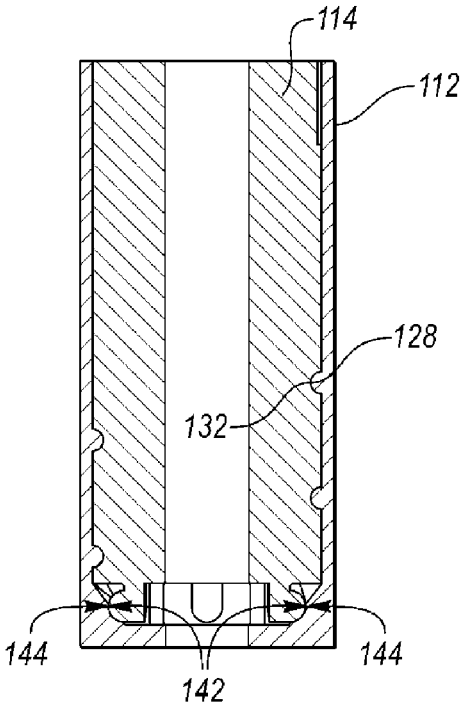
FIG. 7 is a cutaway view along line 6-6 of the alternate embodiment assembled bowling system.

Referring to the cutaway view shown in FIG. 6 along cross section 6-6 of FIG. 4, the arrangement of protrusions 128 provides for a single start position and self-alignment of the inner slug 114 during insertion. By providing a single start position, it is ensured that the slug may be repeatably installed in a ball to a single set position relative to the outer body 112. The outer body 112 includes a uniquely sized helical protrusion 146 having a unique dimension relative to the other protrusions. At the same time, there is a uniquely shaped groove provided on the inner slug 114 which corresponds to the uniquely sized helical protrusion 146 on the outer body. This way, there is only one groove and protrusion combination that allows insertion of the inner slug 114 into the outer body 112. In at least one embodiment, one of the helical protrusions is larger than other protrusions, and is sized to be received in only one groove which is oversized relative to other grooves. By way of example, the nominal protrusion height may be about 0.0625 inches, where a single helical protrusion may have a height of about 0.0935 inches to distinguish from other protrusions. It is further contemplated that different shapes may also be applied to similarly provide a unique protrusion and groove combination that determines the final set position of the slug. In a further embodiment, a single protrusion is provided with a rectangular cross section where other protrusions may each have circular cross sections. Additionally, other features may be suitable to designate a single final set position of a multiple start thread system.

A further aspect of the present disclosure is that the direction of threads may be configured such that repeated torque loads imparted during a bowler's throw are in an install direction of rotation, not a release direction. In this way it reduces the likelihood of an inadvertent release of the inner slug during a bowler's throw. This results in unique configurations for right-handed and left-handed bowlers having different release directions of rotation where one is clockwise, the other being counterclockwise.

Figure 8:
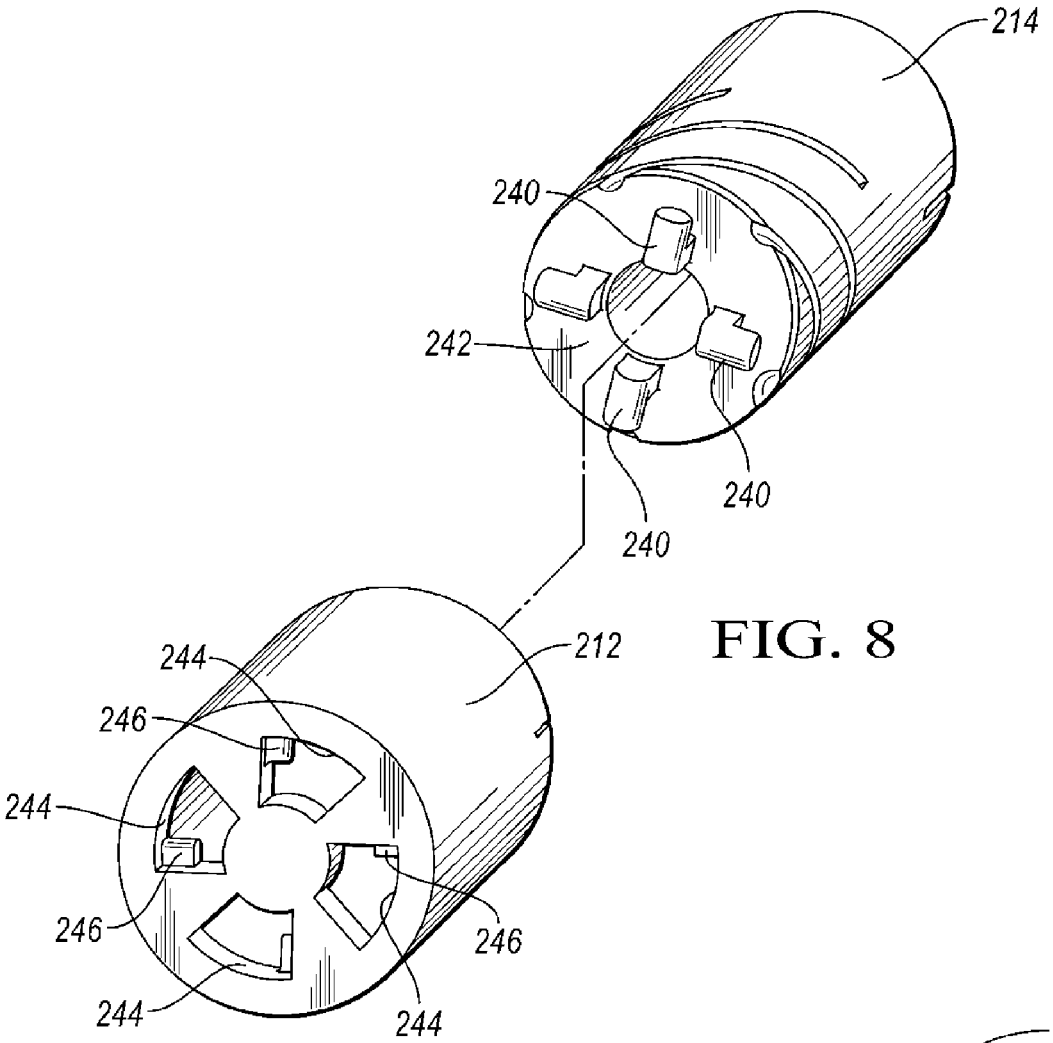
FIG. 8 is an exploded view of a further embodiment bowling system.
Figure 9:
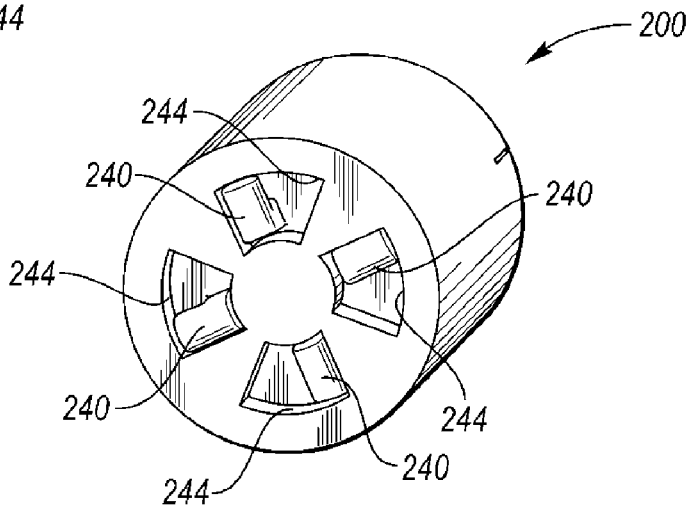
FIG. 9 is a perspective view of an assembled bowling system of the further embodiment of FIG. 8.

Referring to FIGS. 8 and 9, a further embodiment includes a keyed locking feature that operates to retain the inner slug 214 within the outer body 212. The inner slug 214 may include hook features 240 at the proximal end. The hook features 240 may extend radially from a centerline of the inner slug and define a axial gap to a base surface 242. The outer body may include corresponding keyed receiving slots 244 to receive the hook features 240. In this way, the hook features 240 are arranged to rotatingly cinch into the receiving slots 244 provided at the base of the outer body 212. A retaining ledge 246 may extend from one edge of each of the receiving slots 244 to engage one of the hook features 240. An interference fit may be provided between the inner slug and the outer body where the leading edge of each hook 240 creates interference as it passes by a retaining ledge 246. The design interference may provide a rotational resistance both into, and out of, the final set position.

Each of the retention configurations described above may be employed separately, or in combination to achieve a desired retention force.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An interchangeable finger insert apparatus for a bowling ball comprising:

a cylindrical outer body configured to be disposed in a bowling ball hole, the outer body defining an internal bore open to a first end of the outer body, a base at a second end of the outer body and a plurality of protrusions extending from an inner surface of the bore;

a cylindrical inner slug sized to be inserted into the bore of the outer body, the inner slug defining a plurality of helical grooves that correspond to the plurality of protrusions of the outer body, wherein one of the protrusions is uniquely sized relative to other protrusions and corresponds to only one of the helical grooves such that the slug may be rotatably inserted to a single set position; and a compression element attachable to the base wherein the inner slug compresses the compression element when inserted into the bore resulting in a resistive force retaining the inner slug in the set position.

2. The apparatus of claim 1, wherein at least one of the plurality of helical grooves of the inner slug further defines a retaining socket at a terminal end, the retaining socket having a detent and wherein at least one of the protrusions is arranged to nest within the detent to inhibit a counter-rotation removal of the inner slug.

3. The apparatus of claim 1 wherein the inner slug defines a locking feature protruding laterally from an outer surface of the slug to engage a retaining feature defined by the outer body near a second end.

4. The apparatus of claim 3 wherein the locking feature includes a laterally extending prong, and the retaining feature includes a receiving slot, and wherein the set position of the slug within the outer body is defined when the prong is seated within the receiving slot.

5. The apparatus of claim 1 wherein the helical grooves extend along an outer surface of the inner slug from a second end of the inner slug for less than about 50 percent of a total length of the inner slug.

6. The apparatus of claim 1 wherein the inner slug defines a finger cavity extending axially to receive a bowler's finger, the finger cavity including a keyed opening near a base portion to facilitate removal of the inner slug using a tool.

7. An interchangeable finger insert apparatus for a bowling ball comprising:

a cylindrical outer body defining an internal bore being open to a first end of the outer body and at least one protrusion extending from an inner surface of the bore;

an inner slug insertable into the bore of the outer body and defining a plurality of helical grooves on an outer surface, the inner slug further defining a retaining socket disposed at a terminal end of at least one helical groove; and a compression element extending from one of the outer body and the inner slug to engage an other of the outer body and the inner slug;

wherein at least one of the helical grooves corresponds to the at least one protrusion of the outer body such that the at least one protrusion traverses at least one corresponding helical groove to nest within the retaining socket to define a set position of the inner slug, and the compression element generates a resistive force when the inner slug is in the set position thereby retaining at least one protrusion within the retaining socket.

8. The apparatus of claim 7 wherein the at least one protrusion defines a helical shape extending about the inner surface of the bore.

9. The apparatus of claim 7 wherein the at least one protrusion defines an oblong shape to nest within a detent portion of the retaining socket.

10. The apparatus of claim 7 wherein the inner slug defines a finger cavity extending axially to receive a bowler's finger, the finger cavity including a keyed opening near a base portion.

11. The apparatus of claim 7 wherein the at least one protrusion comprises a plurality of protrusions, and one of the plurality of protrusions is uniquely shaped relative to other protrusions to correspond to a uniquely shaped groove to define a single set position.

12. The apparatus of claim 7 wherein the inner slug includes at least one deformable prong protruding axially from a second end, and the outer body including at least one corresponding recessed detent, the at least one deformable prong being configured to deformably seat into the at least one recessed detent at a final set position of the inner slug.

13. A bowling system including an interchangeable finger insert comprising:

a bowling ball defining a blind hole;

a cylindrical outer body disposed in the blind hole and defining an internal bore being open to a first end of the outer body and at least one protrusion extending from an inner surface of the bore near a second end of the outer body;

a compression element affixed to the second end of the outer body; and an inner slug sized to fit within the bore of the outer body and defining a plurality of helical grooves on an outer surface that correspond to the at least one protrusion of the outer body, wherein the inner slug is capable of rotatable insertion into the bore of the outer body such that the at least one protrusion traverses at least one helical groove and the compression element generates a resistive force to retain the inner slug in a set position.

14. The bowling system of claim 13 wherein the inner slug further defines a retaining socket disposed at a terminal end of at least one helical groove, and a protrusion is arranged to nest within a detent of the retaining socket at the set position.

15. The bowling system of claim 14 wherein the inner slug is released from the set position by over-compressing the compression element to unseat the protrusion from the detent.

16. The bowling system of claim 13 wherein the at least one protrusion defines a helical shape extending about the inner surface of the bore.

17. The bowling system of claim 13 wherein the inner slug defines a finger cavity extending axially to receive a bowler's finger, the finger cavity including a keyed opening near a base portion.

18. The bowling system of claim 13 wherein the inner slug includes a locking feature protruding laterally from the outer surface of the slug to engage a retaining feature disposed near the second end of the outer body.

* * * * *